US007707683B2

(12) United States Patent
Nurudeen

(10) Patent No.: US 7,707,683 B2
(45) Date of Patent: May 4, 2010

(54) SWEEPER VACUUM CLEANER ASSEMBLY

(76) Inventor: Selim Nurudeen, 1216 Eagle Lakes Dr., Friendswood, TX (US) 77546

( * ) Notice: Subject to any disclaimer, the term of this patent is extended or adjusted under 35 U.S.C. 154(b) by 938 days.

(21) Appl. No.: 11/359,180

(22) Filed: Feb. 22, 2006

(65) Prior Publication Data

US 2007/0000815 A1 Jan. 4, 2007

Related U.S. Application Data

(60) Provisional application No. 60/594,383, filed on Apr. 1, 2005.

(51) Int. Cl.
*A47L 5/24* (2006.01)

(52) U.S. Cl. ..... 15/344; 15/328; 15/330; 15/159.1; 15/201

(58) Field of Classification Search ..... 15/328, 15/330, 344, 159.1, 201
See application file for complete search history.

(56) References Cited

U.S. PATENT DOCUMENTS 2,674,001 A * 4/1954 Abrams et al. ..... 15/184
5,839,158 A * 11/1998 Schupp et al. ..... 15/350
6,029,311 A * 2/2000 Scanni et al. ..... 15/344

* cited by examiner

*Primary Examiner*—Joseph J Hail, III
*Assistant Examiner*—Shantese McDonald
(74) *Attorney, Agent, or Firm*—Delphine James

(57) ABSTRACT

The present invention comprises a rechargeable battery operated combination sweeper/vacuum assembly for picking up debris that is swept into a pile. The assembly further comprises an elongated handle, a sweeper member, and a vacuum member. A compartment for housing the rechargeable battery is mounted to the upper end of the elongated handle. Mounted to the lower end of the handle is the sweeper member which further comprises a housing adapted to slidably receive the bristles of the sweeper member. Mounted to the backside of the housing is the vacuum member which further comprises a removable cover constructed in the shape of a dust pan. The removable cover of the vacuum member can be used as a conventional dust pan with the sweeper portion of the present invention.

14 Claims, 15 Drawing Sheets

SWEEPER VACUUM CLEANER ASSEMBLY

This application claims filing date of provisional application: 60/594,383 Apr. 1, 2005

BACKGROUND

The present invention relates to cleaning appliances and more particularly, a combination assembly containing a sweeper for collecting debris and a vacuum cleaner for picking up the collected debris.

Normally, a broom is used to sweep debris into a pile and the pile of debris is then swept into a dust pan. The dustpan is then emptied into a garbage container. Sometimes all the debris is not transferred to the dustpan. It is also easy to spill the debris from the dustpan.

U.S. Pat. No. 5,617,610 issued Apr. 8, 1997 discloses a self-contained sweeper and vacuum pick-up. This device comprises a broom and a rechargeable vacuum assembly. However, the present invention provides a uniquely designed broom and vacuum assembly.

SUMMARY

One of the main objectives of the present invention is to provide a sweeper/vacuum assembly for sweeping and picking of piles of debris.

The present invention comprises a rechargeable battery operated combination sweeper/vacuum assembly for picking up debris that is swept into a pile. The assembly further comprises an elongated handle, a sweeper member, and a vacuum member. A compartment for housing the rechargeable battery is mounted to the upper end of the elongated handle. Mounted to the lower end of the handle is the sweeper member which further comprises a housing adapted to slidably receive the bristles of the sweeper member. Mounted to the backside of the housing is the vacuum member which further comprises a removable cover constructed in the shape of a dust pan. The removable cover of the vacuum member can be used as a conventional dust pan with the sweeper portion of the present invention.

Further advantages of the present invention will become apparent after reading the detailed description in conjunction with the attached drawings.

BRIEF DESCRIPTION OF DRAWINGS

FIG. 8A is a side enlarged exploded view of the vacuum assembly.

DETAILED SPECIFICATIONS

Figure 1:
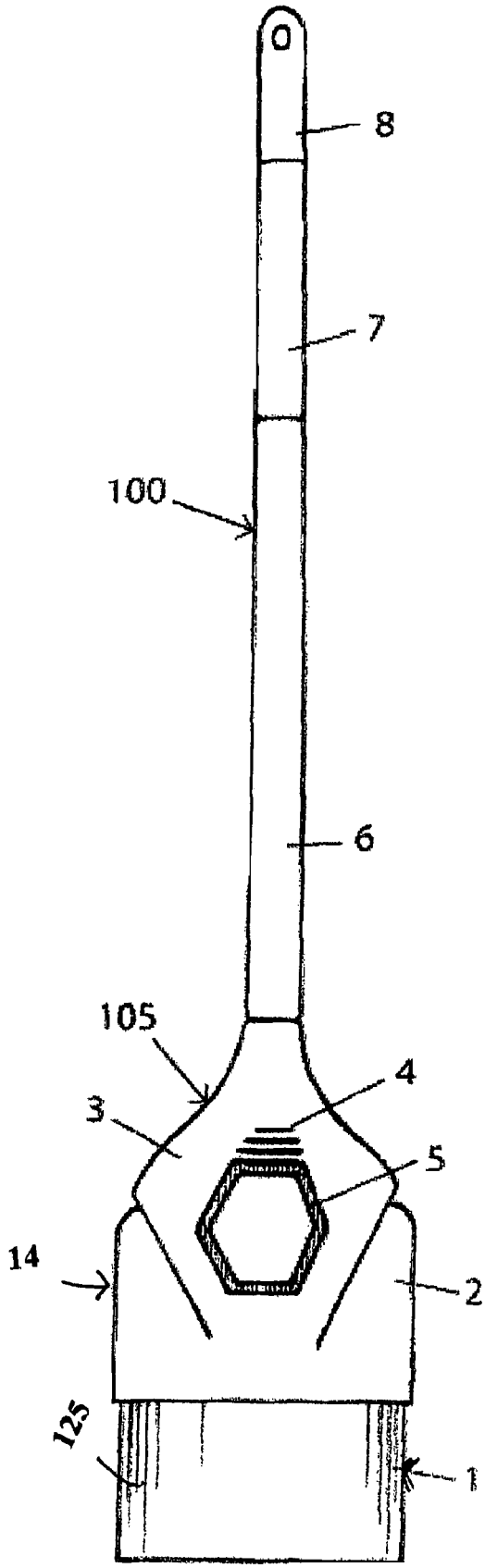
FIG. 1 is a frontal perspective view of the sweeper/vacuum assembly of the present invention.

Referring to FIGS. 1, 2, 3, 4 and 6 there is shown an embodiment the present invention a combination sweeper/vacuum assembly. The invention further comprises an elongated handle (100) segmented into an upper portion (7) and a lower portion (6). Disposed at the bottom of the lower portion (6) of the elongated handle (100) is a combined assembly of sweeper member (1) and battery operated vacuum member (210).

Figure 15:
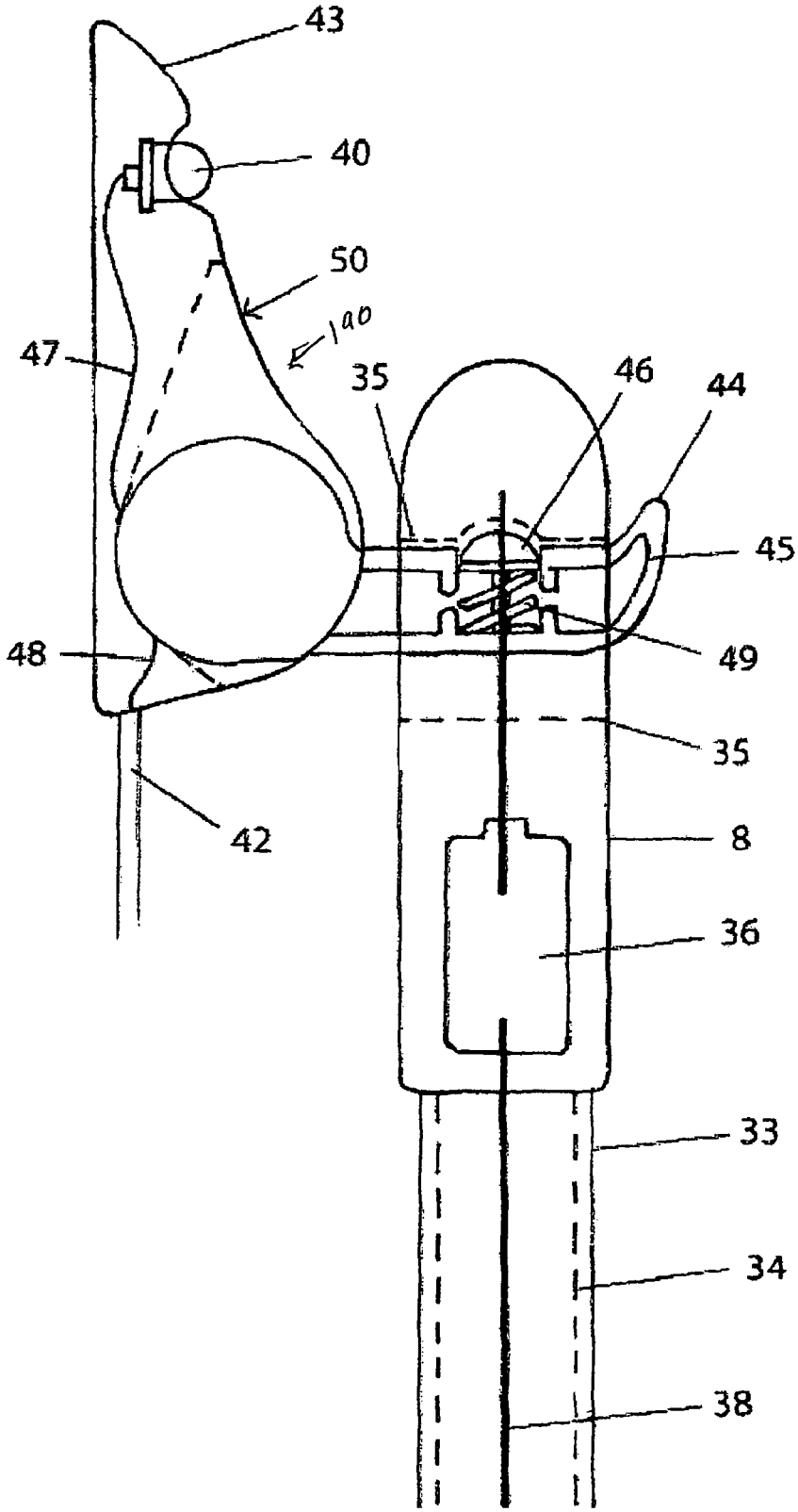
FIG. 15 is a side view of the battery charger inserted.

Disposed at the top of the upper portion (7) of the elongated handle (100) is compartment (8) which is adapted to contain a rechargeable battery unit 36 shown in FIG. 15. A re-charger unit (50) can be provided to interface with the housing current. The details will be described further below.

Figure 2:
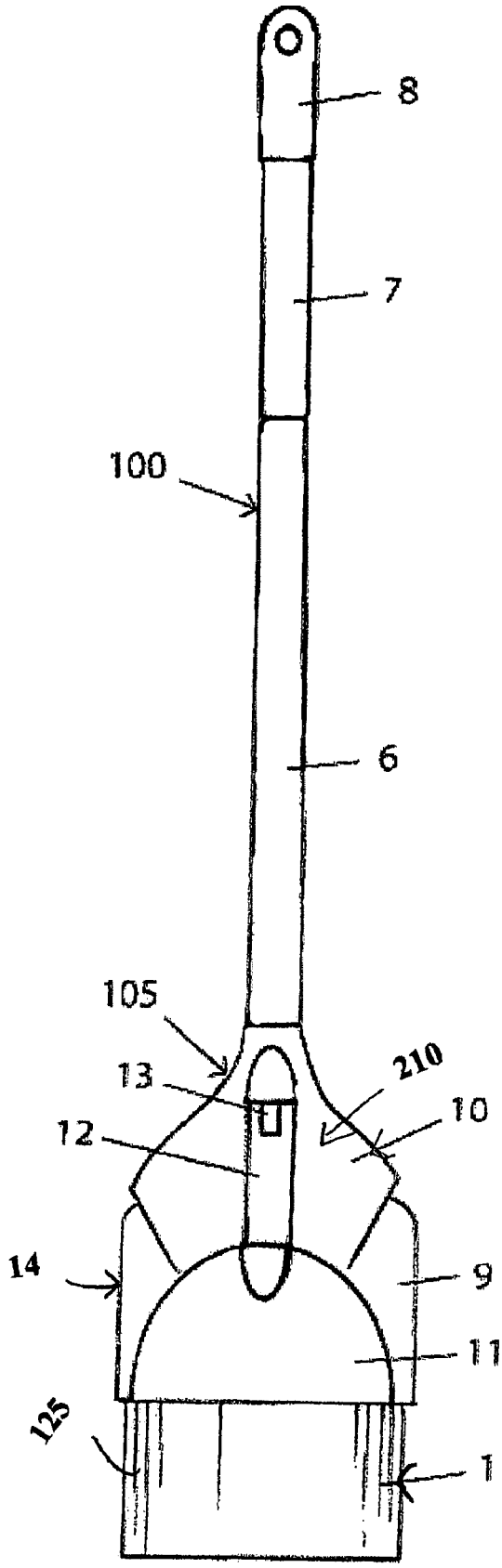
FIG. 2 is a back perspective view of the sweeper/vacuum assembly of the present invention.
Figure 3:
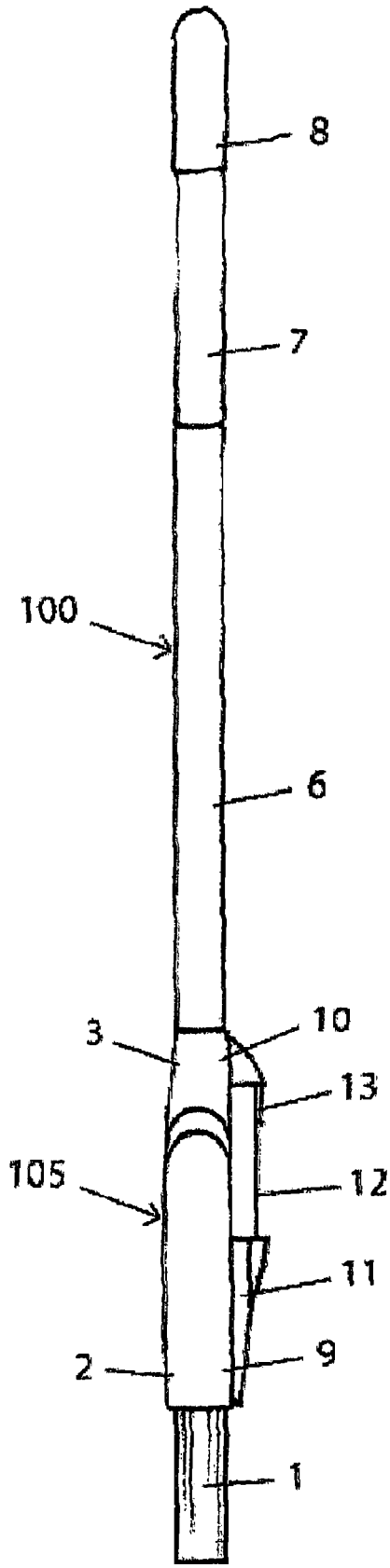
FIG. 3 is a side perspective view of the sweeper/vacuum assembly of the present invention.
Figure 6:
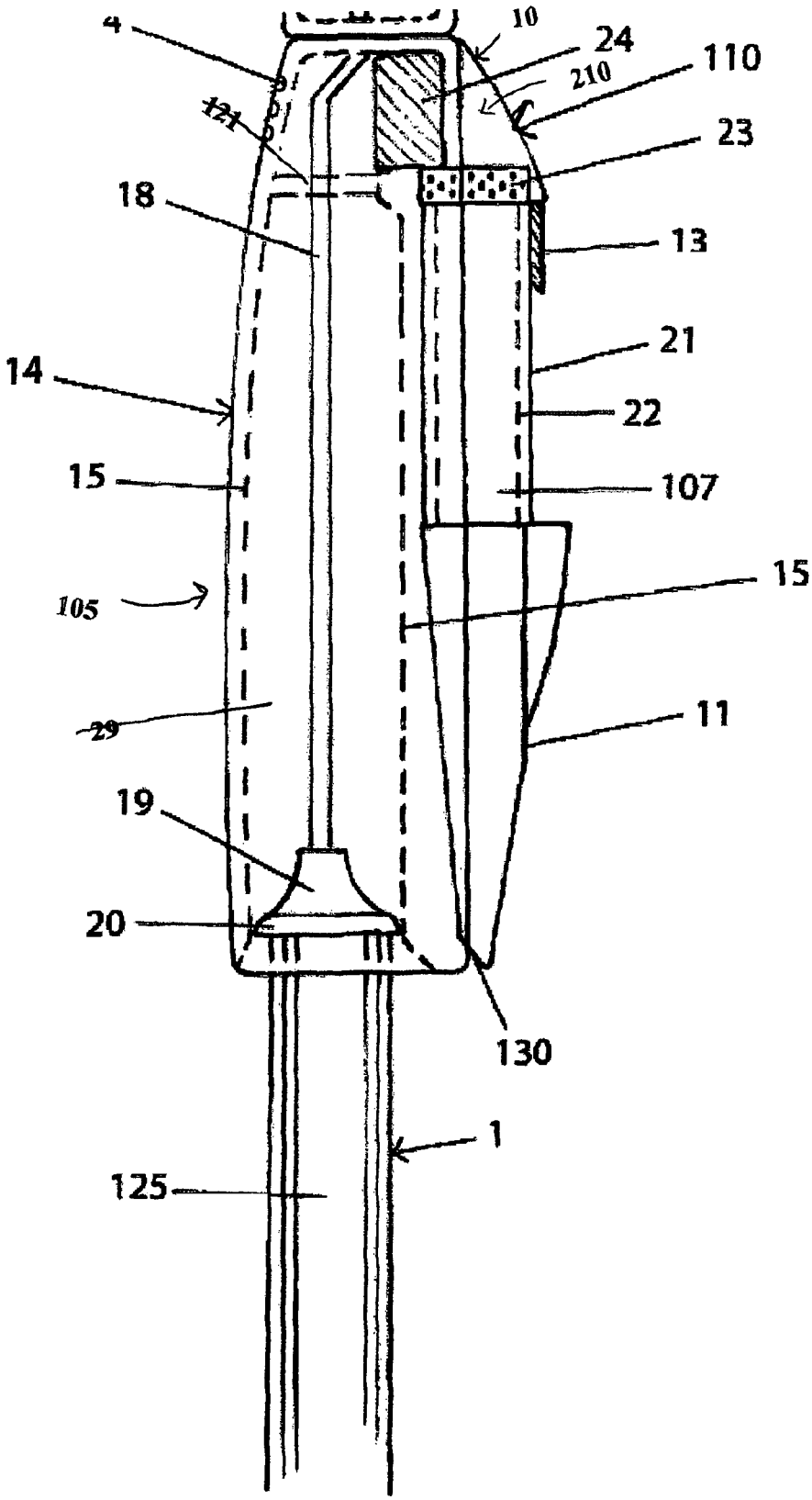
FIG. 6 is an enlarged cross-sectional side view of the sweeper extended.
Figure 7:
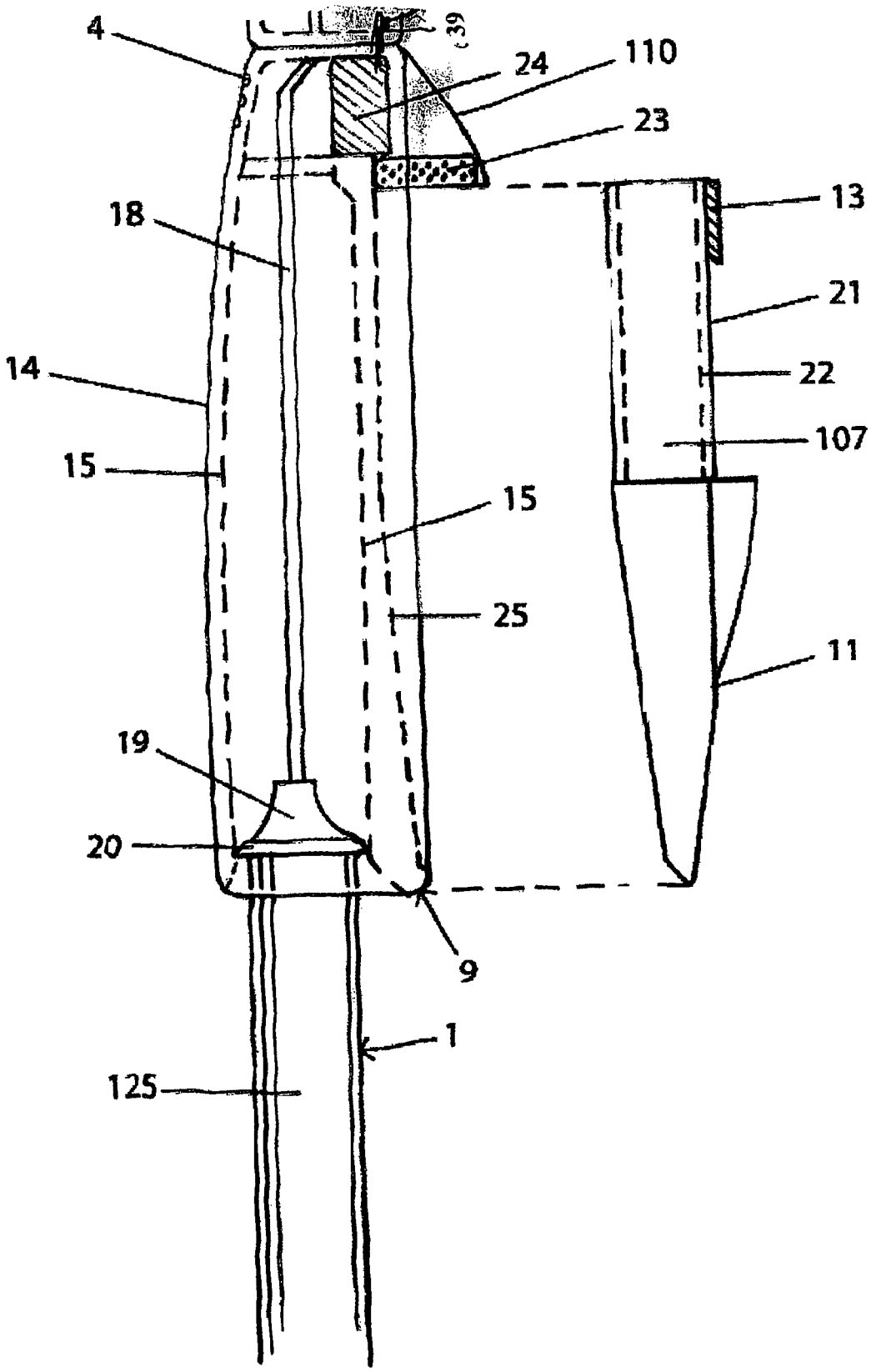
FIG. 7 is an enlarged cross-sectional side view with the vacuum cover removed.
Figure 8B:
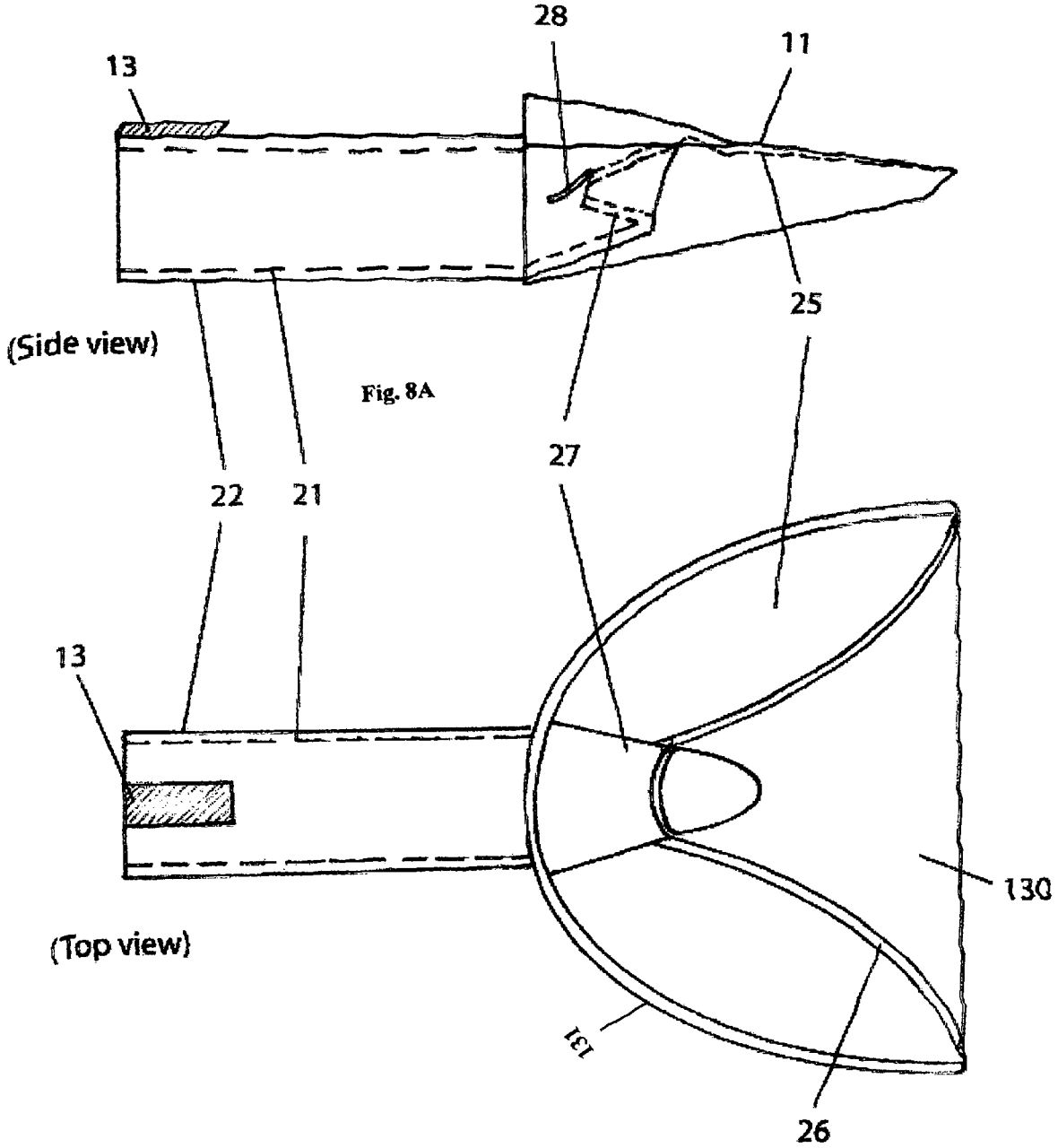
FIG. 8B is a top enlarged exploded view of the vacuum assembly.
Figure 9:
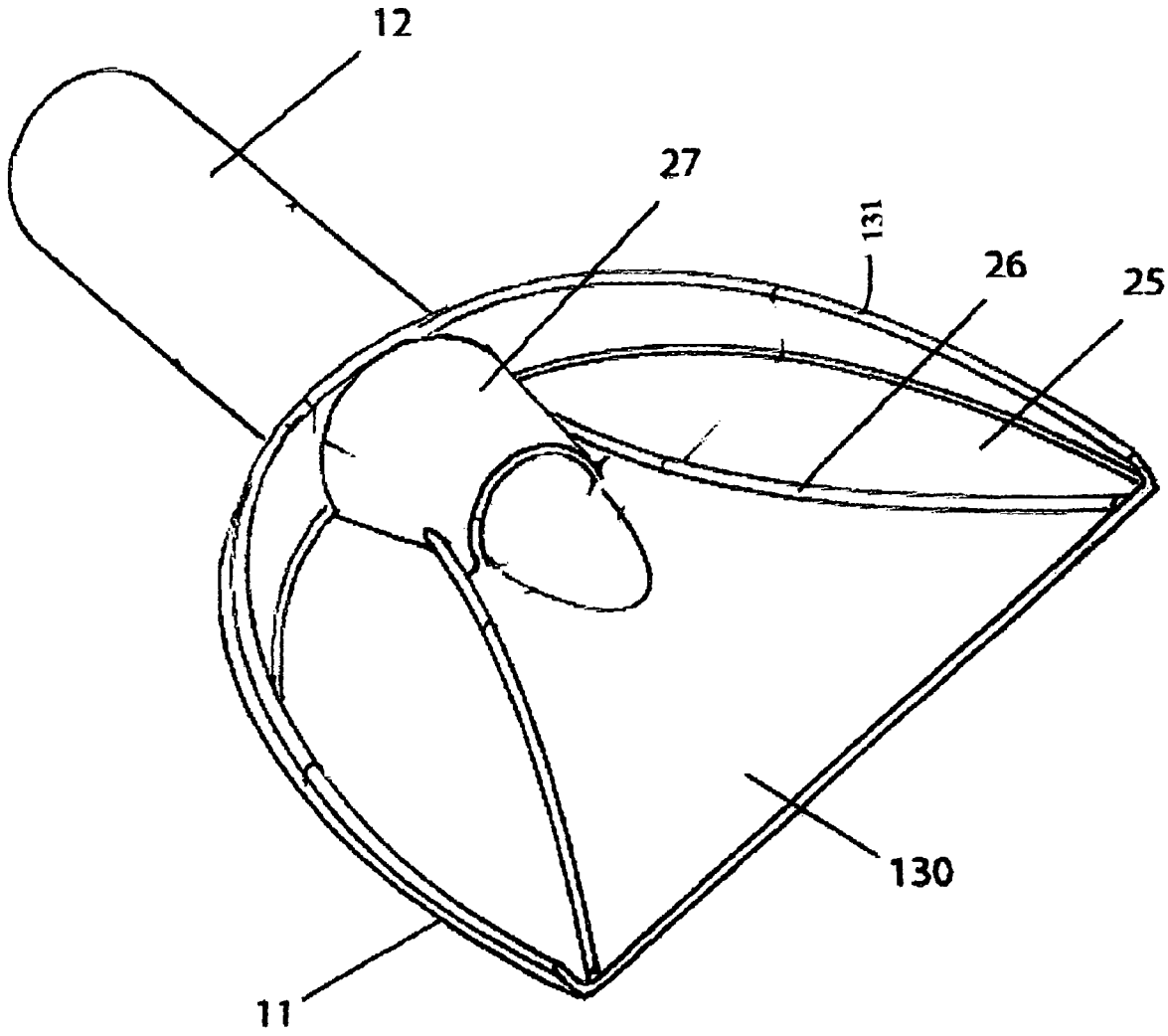
FIG. 9 is an enlarged top view of the vacuum cover.

Disposed at the bottom of the lower portion (6) of the elongated handle (100) is housing (105) which supports the combined assembly of sweeper member (1) and battery operated (210). Housing (105) is vertically mounted to the bottom end of the lower portion (6) of handle (100). As shown in FIGS. 1 and 2, housing (105) includes a plurality of interconnected outer walls (14) forming an interior cavity therein. The interior cavity of housing 105 is further partitioned into a plurality of internal chambers therein. Housing (105) further includes lower front wall (2), upper front wall 3, lower rear wall 9, and upper rear wall 10 which are interconnected to form the outer wall 14. As shown in FIG. 6, horizontally extending interior wall 121 partitions the internal cavity of housing 105 into a upper vacuum compartment (110) and lower compartment. As shown in FIG. 6, vertically extending interior wall (15) partitions the lower compartment of the interior cavity of housing 105 into first internal chamber (29) (shown in FIG. 4) and a second internal chamber (107) (shown in FIG. 6).

Sweeper member (1) comprises a plurality of bristles (125) conventionally mounted to horizontally displaced bracket (19) within first interior chamber (29). First interior chamber 29 is shaped and dimensioned to generally surround and thereby house sweeping member (1). Shaft (18) extends vertically downward internally through handle (100) and into first internal chamber (29). Bracket (19) is affixed to the lower end of shaft (18) by coupling member 20 thereby connecting the bristles (125) of sweeper member (1) to the lower end of shaft (18). Sweeper member (1) is slidably mounted to shaft (18) within first internal chamber (29) for sliding in the vertical direction between a first extended position shown in FIG. 4 and a second retracted position shown in FIG. 5. Internal wall (15) prevents debris from entering first internal chamber (29) when vacuum member (210) is activated.

In the first extended position of sweeper member (1) the broom bristles (125) extend outwardly from first internal chamber (29) through the bottom thereof. Sweeper member (1) bristles (125) extend outwardly to the conventional broom length of at least 2 inches to allow for manual sweeping. In the second retraced position of sweeper member (1), the broom bristles (125) are retracted inwardly and confined within first internal chamber (29).

Protective cover (11) is vertically and removably mounted to lower rear wall (9) opposing interior wall (15). When protective cover (11) is attached to lower rear wall 9, second interior chamber (107) is formed with an inlet (130) formed at the bottom thereof.

Referring to FIGS. 8A, 8B, 9, and 10, when removed, protective cover (11) is configured and dimensioned to be used as a conventional dustpan. As a dustpan, protective cover (11) further includes a lower portion (51) with an affixed collector handle (12). Lower portion (51) is dimensioned and configured as a conventional scooper for collecting debris when sweeper member (1) is used as a conventional broom. As shown lower portion 51 has a conventional semi-circular scooper shape.

Collector handle (12) is hollow, has a cylindrical shape, and protrudes slightly inwardly into lower portion 51 to form a vacuum inlet 27. On opposing sides of vacuum inlet 27, opposing sealing members (26) are mounted onto the interior wall of lower portion 51. Each sealing member 26 defines a flange which curves outward from vacuum inlet 27 into a corner near the lower peripheral edge of lower portion 51. When protective cover (11) is re-attached to lower rear wall 9, the vacuum inlet 27 can function as a debris collector during the operation of vacuum member (210) housed in vacuum compartment 110. Sealing member can be made of a plastic material. Additionally, connection flanges 131 are formed along the outer curved peripheral edges of lower portion 51.

Figure 10:
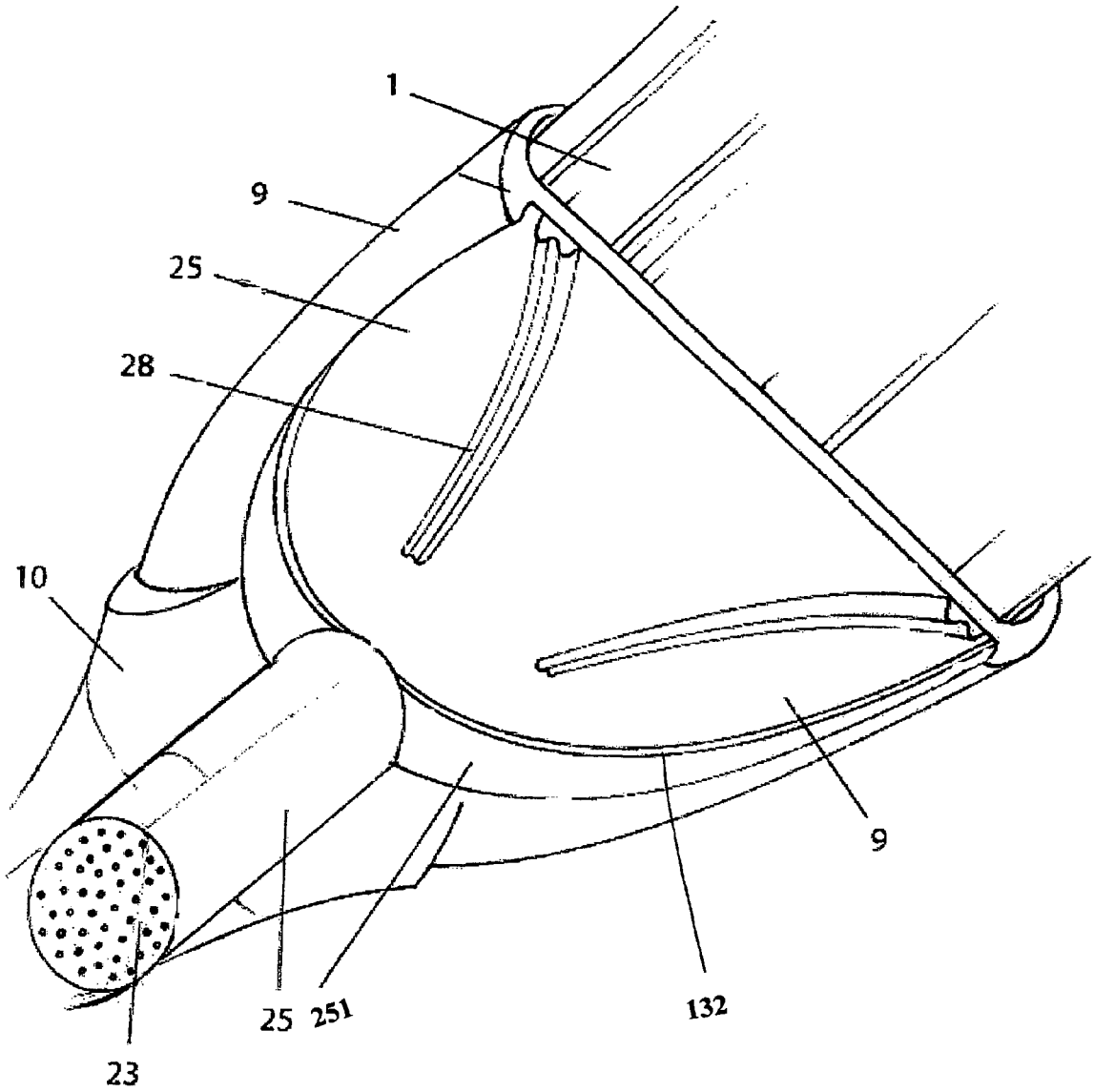
FIG. 10 is an enlarged to view of the vacuum assembly without cover.
Figure 11:
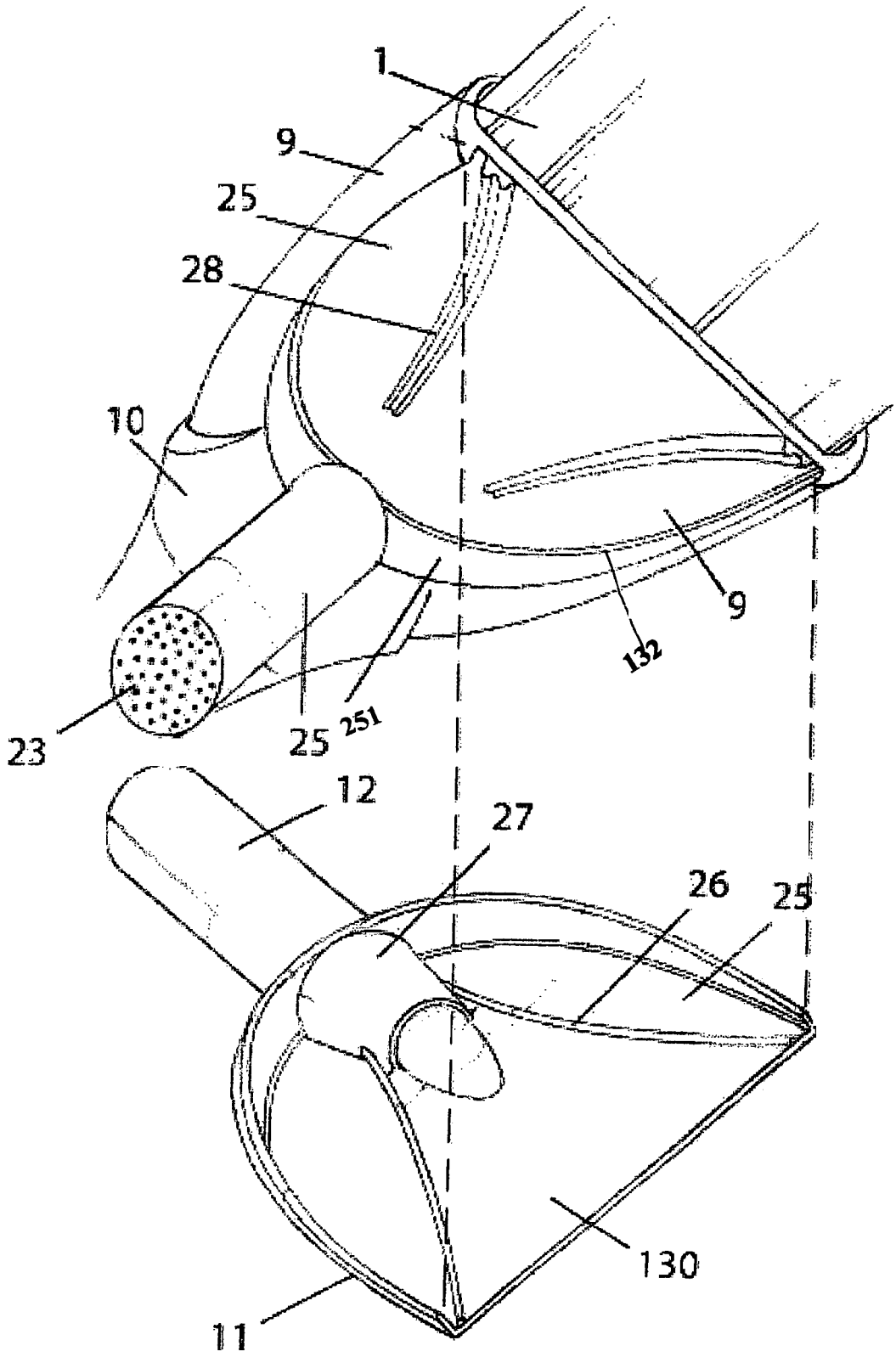
FIG. 11 is an exploded enlarged view of the vacuum assembly with cover.

As shown in FIG. 10, dust pan support bracket 132 is formed upon lower rear wall 9 to support the reattachment of protective cover (11). Dust pan support bracket 132 is configured and adapted to receive protective cover 11. Dustpan support bracket 132 further comprises a top portion 25 and a lower portion 251. Top portion 25 forms a receptacle configured and adapted to receive collector handle 12 shown in FIG. 9. Lower portion 251 has a semi-circular shape adapted to securely engage with lower portion 51 of protective cover 11. Along interior wall 15 are mating sealing member recesses 28 which are adapted to securely engage with sealing member (26). The curved edges of lower portion 251 are adapted with connection recess 28 to securely engage with connection flanges 132 of lower portion 51 of protective cover 11. As depicted in FIG. 6, reattaching protective cover 11 to lower rear wall 9 forms an air passageway through inlet 130 and into vacuum inlet 27 shown in FIG. 9. The air passageway through inlet 130 is fully open during the operation of vacuum 10 which allow the collection of debris into collector handle 12 shown in FIG. 9. Connection recesses 28 and sealing member 26 provides the means for attachment of cover 11 to lower rear wall 9. Disposed within vacuum inlet 27 is a flap, which supports reattachment of cover 11 to rear wall 9. Additionally, disposed within handle 12 on the end opposing vacuum inlet 27 is a rubber flap 128 which also allows dirt into the receptacle but not out.

Disposed upward from and above second internal chamber (107) and internal chamber (29) is completely confined vacuum compartment (110). Vacuum compartment 110 is adapted to operationally support the suction means components of (i.e. fan, filter, and motor—) of vacuum member (210). A motor 24 is internally mounted inside vacuum compartment 110 which turns on a fan (not shown) also mounted within vacuum compartment 110. The rotation of fan creates a vacuum, which causes air to force debris through inlet (130) through vacuum inlet 27 and into collector handle (12). Air filter (23) is removably mounted within the upper end of receptacle (24) disposed between vacuum inlet 27 and vacuum compartment 110. Disposed within the upper frontal wall 3 of housing 105 is exhaust outlet 4. Exhaust outlet 4 further comprises a plurality of apertures extending into vacuum compartment 110. Exhaust outlet 4 support the suction means of vacuum member 210.

Figure 4:
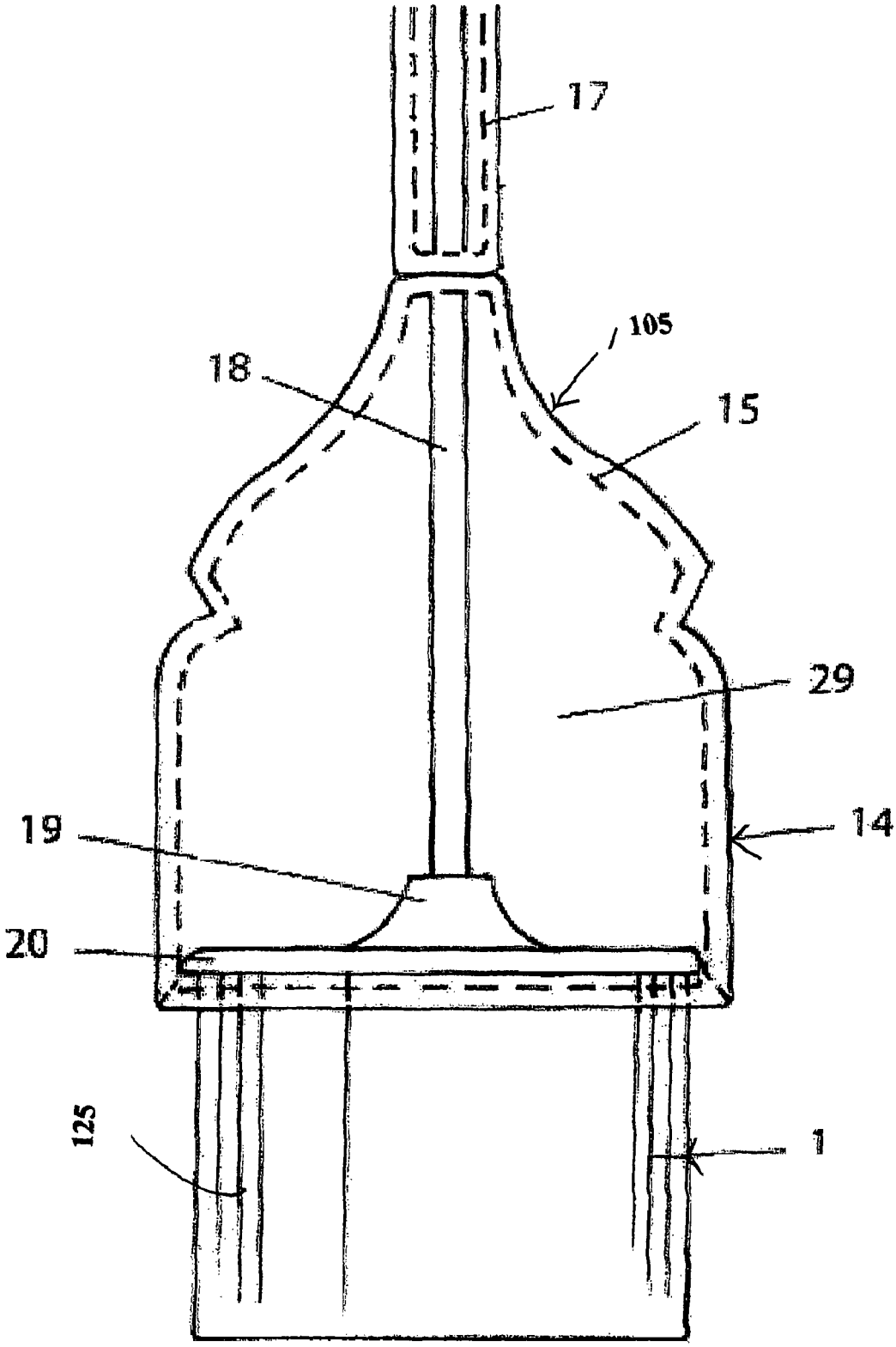
FIG. 4 is an enlarged cross-sectional view of the sweeper extended.
Figure 5:
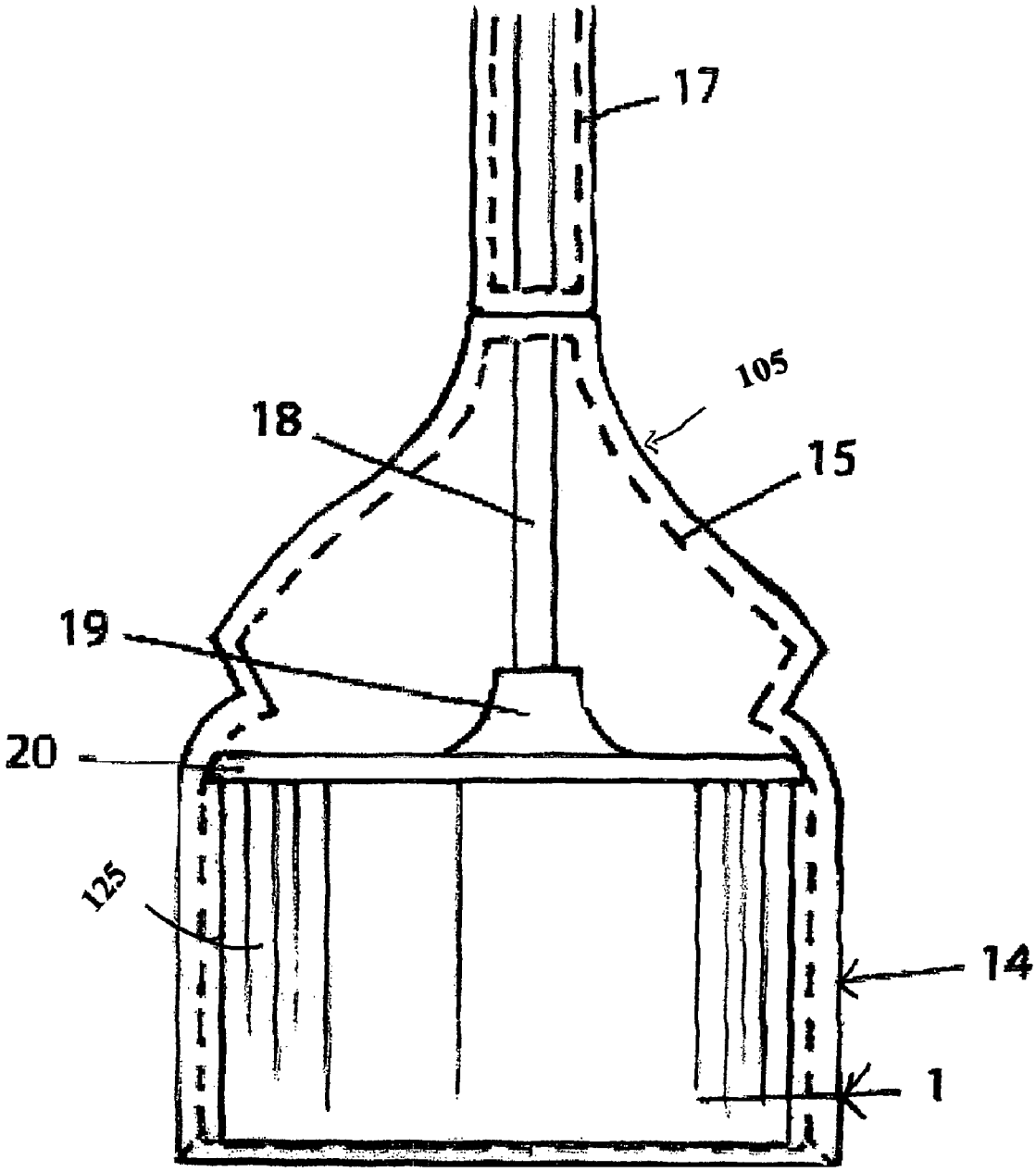
FIG. 5 is an enlarged cross-sectional view of the sweeper non-extended.
Figures 12A, 12B:
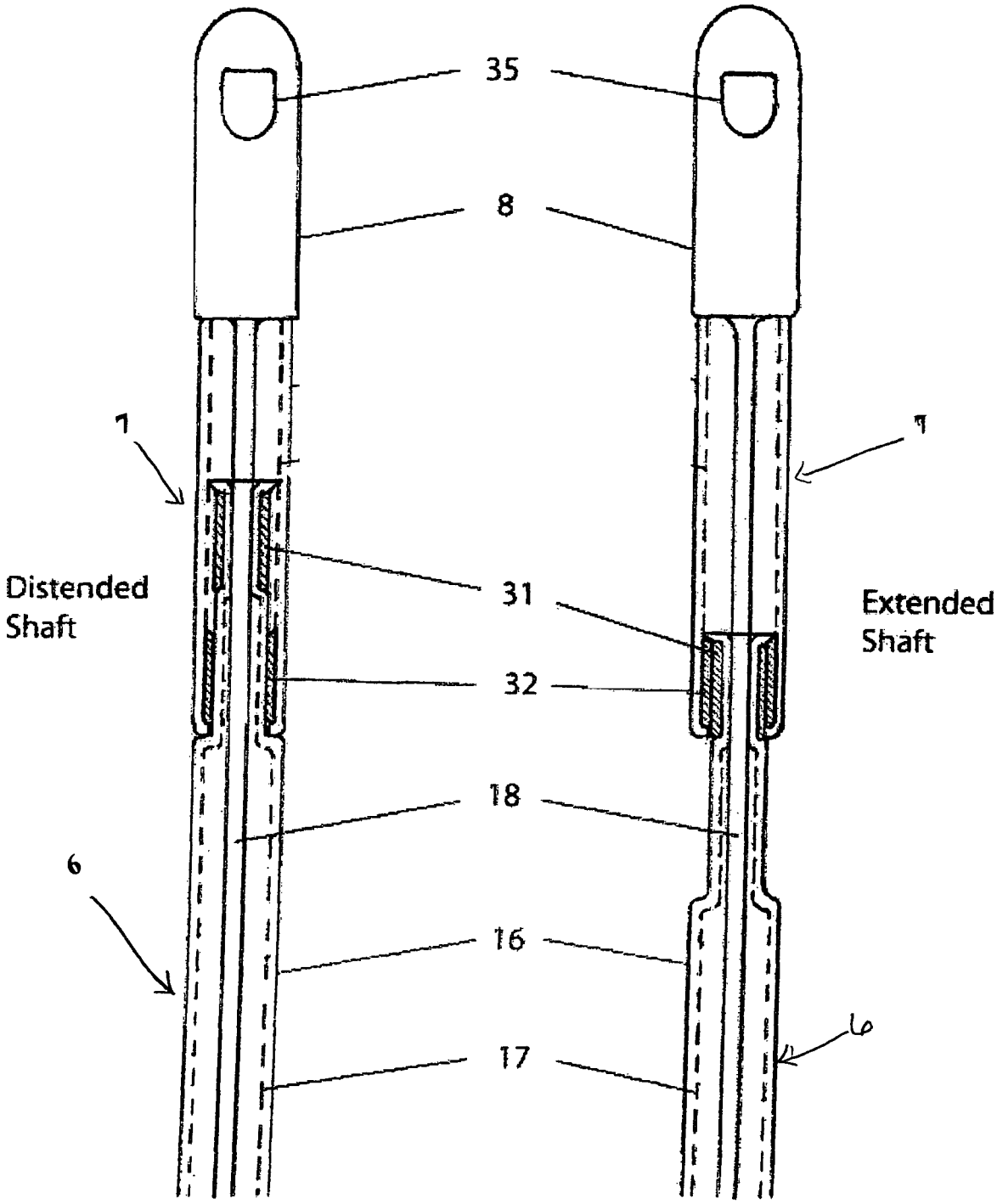
FIG. 12A is an enlarged cross-sectional view top view of the elongated handle with the internal shaft distended.
FIG. 12B is an enlarged cross-sectional view top view of the elongated handle with the internal shaft extended.
Figure 13:
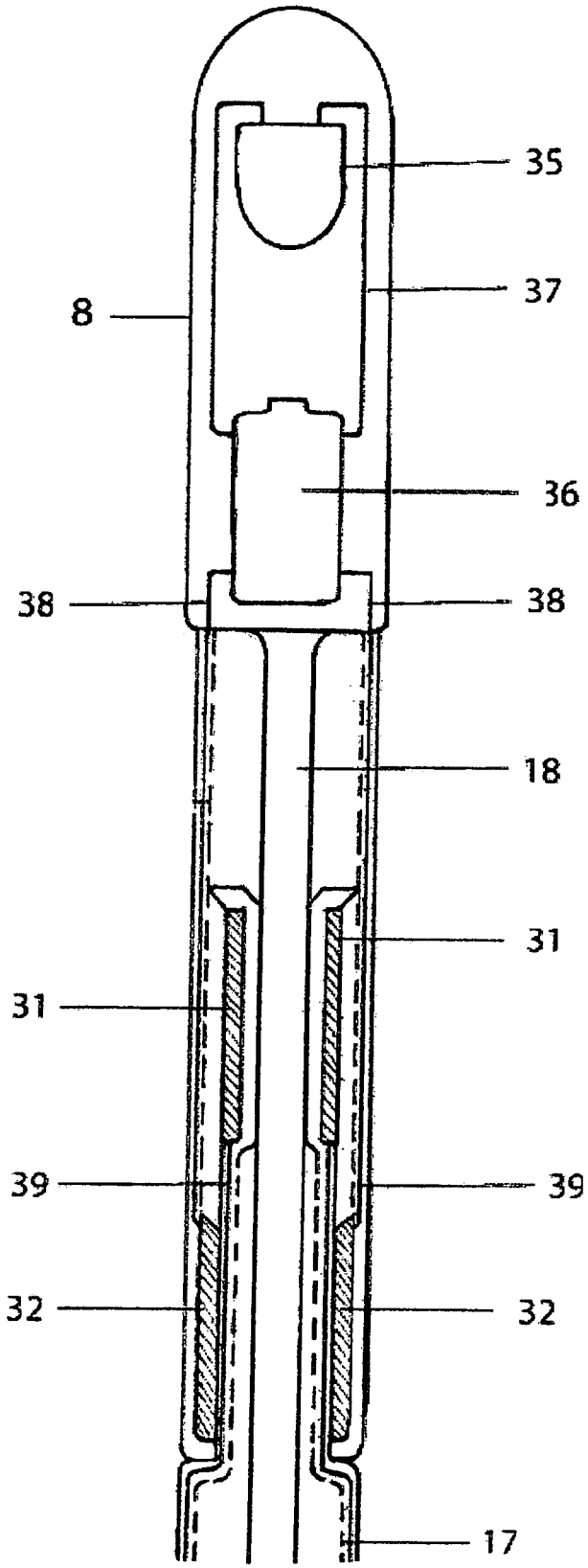
FIG. 13 is a cross-sectional view of the handle.

As shown in FIGS. 12A and 12B, handle (100) further comprises a hollow cavity with shaft (18) extending therethrough. As shown in FIG. 4, shaft 18 extends into first internal chamber (29) within housing (105). The lower end of shaft (18) is connected to sweeper member (1) via bracket member (19). As shown in FIG. 12B, upper portion (7) of handle (100) is slidably connected the lower portion (6) of handle (100) with switch control mechanism (31, 32) incorporated therebetween. Switch mechanism (31, 32) is electrically connected to vacuum member 10 via wires 38 and 39.

When the upper portion (7) of handle (100) is slid upward from the lower portion (6) of handle (100), shaft (18) extends upwardly thereby retracting the bristles (125) of sweeper member (1) into the first internal chamber (29). Simultaneously, switch control mechanism (31) is slid upward to align with mating electric connection (32) thereby activating vacuum member (210). Additionally, when the bristles of sweeper member (1) are pulled up the first internal chamber (29) of housing (105), inlet (130) of the vacuum member (210) is exposed allowing debris to be forced upward into collector member (12) through vacuum inlet (27).

When the upper portion (7) of handle (100) is slid downward toward the lower portion (6) of handle (100), shaft (18) extends downwardly thereby extending the bristles (125) of sweeper member (1) outwardly from the first internal chamber (29). Simultaneously, the electric connection between switch control mechanism (31) and mating connection (32) is broken thereby deactivating vacuum member (210). When the upper portion of handle (100) is slid downward, the present invention can be utilized as a conventional broom.

Switch control mechanism (31) further comprises an upper DC commutator (31) and a lower mating DC commutator (32) operationally mounted on each side of shaft (18) within the interior cavity 17 of handle (100) between the connection between the upper portion (6) and the lower portion (7) of handle (100). Electrical wires 38 electrically connect the upper DC commutator 31 to the battery 8. Electrical wires 39 electrically connect the lower DC commutator 32 to motor 24 of vacuum member 10.

When the upper portion (7) of handle (100) is slid upward from the lower portion (6) of handle (100), the upper DC commutator (31) and lower (32) DC commutator on each side of shaft (18) are aligned thereby establishing the electrical connection to activate vacuum member 10. Alternatively, when the upper portion (7) of handle (100) is slid downward toward the lower portion (6) of handle (100), the upper (31) and lower (32) DC commutators on each side of shaft (18) are completely separated thereby breaking the electrical connection and deactivating the vacuum member (210).

Figure 14B:
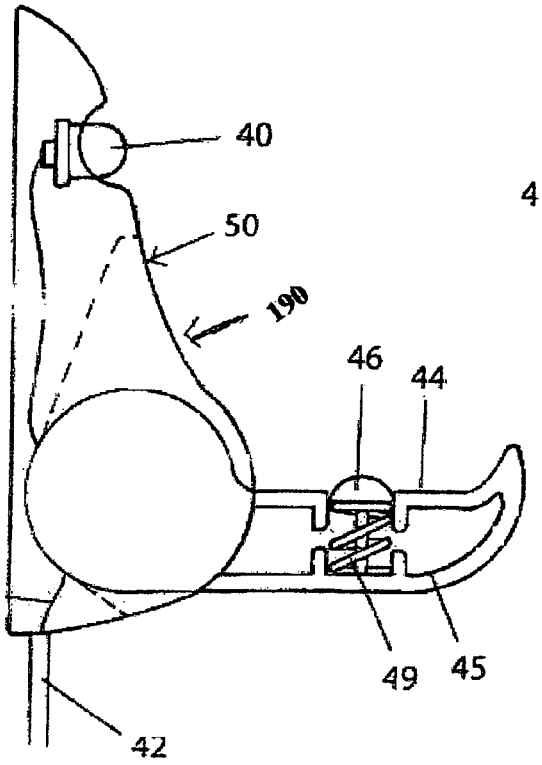
FIG. 14B is side view of the battery charger.
Figure 14A:
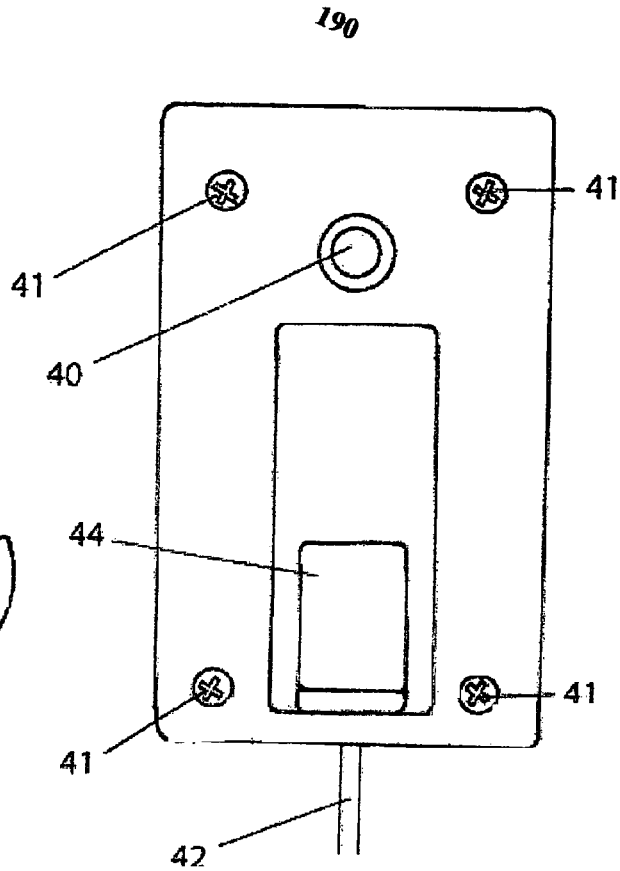
FIG. 14A is frontal view of the battery charger.

Referring to FIGS. 14A and 14B, there is shown respectively a frontal and side view of battery charger 50. As depicted, battery charger 50 is mounted to the wall at a predetermined height utilizing fastening means 41 (i.e. screws). Cord 42 provides a connection (not shown) a convention electrical outlet. Hook 44 protrudes outwardly and is adapted to electrically connect with battery 36. To initiate charging hook 35 is attached to hook 44 that creates an electrical connection with switch control 46. Wires 37 connect charger 50 to battery 36. As shown, switch control 46 is spring loaded type connection. Thus, as shown in FIG. 15, when handle 100 is mounted to charger 50, spring 49 is depressed activating electrical connection 46 to initiate charging of battery 36. Electrical wires 37 electrically connect batter 36 to switch control 46.

What is claimed is:

1. A combination sweeper and vacuum assembly device, the device comprising: an elongated handle having an internal conduit therein, the elongated handle having an upper section, and lower section; the upper section slidably connected to the lower section; a housing having an interior cavity therein, the housing affixed to a lower end of the handle, the housing defined by a front outer wall and a back outer wall; the interior cavity horizontally partitioned into an upper compartment and a lower compartment; the lower compartment vertically partitioned by an interior wall into a first internal chamber on a front side of the interior wall and a second internal chamber on the backside of the interior wall; the first internal chamber configured and dimensioned to contain a sweeper member; a vacuum member operated by a battery, the vacuum member operationally mounted within the upper compartment; a protective cover forming a portion of the back outer wall, the cover adapted to be removed and configured as a conventional dust pan; a switch mechanism operationally mounted at the juncture between the upper section and the lower section, the switch mechanism electrically connected to the vacuum member; the upper section of the handle movable upwardly into an extended position such that the switch mechanism simultaneously activated the vacuum member; and the upper section of the handle movable downwardly into a retracted position such that the switch mechanism simultaneously deactivates the vacuum member.

2. The device of claim 1 wherein the sweeper member further comprising a plurality of bristles.

3. The device of claim 1 further comprising a shaft member extending through the internal conduit from the top end and into the first internal chamber of the housing, a lower end of the shaft member attached to the sweeper member.

4. The device of claim 3 wherein the shaft member is slidably connected to the upper section of the handle such that as the upper section of the handle is pulled upward the sweeper member is pulled upward into the first internal chamber.

5. The device of claim 1 wherein the vacuum member further comprises suction means operationally mounted within the upper compartment.

6. The device of claim 1 further comprising: an exhaust outlet for the vacuum member, the exhaust outlet disposed upon the front wall of the upper compartment; and the exhaust outlet further comprising a plurality of apertures extending into the cavity of the upper compartment.

7. The device of claim 6 further comprising a battery charging mechanism removably and operationally connected to battery compartment.

8. The device of claim 7 wherein the battery charger further comprises: a second housing configured to be mounted to a wall at a predetermined distance above ground level; a handle connector affixed to a front side of the second housing; a mating connector affixed to the battery compartment; a switch mechanism situated within the handle connector; and the handle connector adapted to securely engage with the mating connector activating the charging of the battery and securing the handle to the battery charger.

9. The device of claim 8 further comprising an indicator light operationally mounted to the front side of the second housing.

10. The device of claim 1 further comprising: a battery compartment for housing the battery; the battery compartment disposed upon a top end of the upper section of the handle; and the battery electrically connected to the vacuum member through the internal conduit.

11. The device of claim 1 wherein the protective cover further comprises: A hollow and substantially cylindrical handle affixed to a scooper lower portion; the lower portion being configured to be utilized as a scooper of a conventional dustpan when the cover is detached from the back outer wall; and upon reattachment of the cover to the back outer wall, the handle being adapted to be used as a collector of debris during operation of the vacuum member.

12. The device of claim 11 wherein the handle further comprises a portion protruding slightly into the lower portion to define an inlet for the collection of debris into the handle upon activation of the vacuum member.

13. The device of claim 12 further comprising: a pair of first connecting flange sealing members disposed on opposing sides of the inlet; each sealing member affixed to an interior wall of the lower portion; each sealing member curving outward from the inlet to a lower peripheral edge of the lower portion; a second connection flange defined along an outer curved peripheral edge of the lower portion; and upon reattachment of the cover to the outer back wall, the pair of sealing members defining an air passageway into the inlet during the operation of the vacuum member.

14. The device of claim 13 further comprising: a dustpan mount affixed to the backside of the interior wall, the dustpan mount including a pair of first mating connection recess and a second mating connection recess; the pair of first mating connection recess disposed upon the backside of the interior wall, the pair of first mating connection recesses adapted to securely engage with the pair of sealing members; a second mating connection recess disposed upon the back outer wall outlining a contour of the detached cover; and the second connection recess adapted to securely engage with the second connection flange to define the second internal chamber upon reattachment of the cover to the back outer wall.

* * * * *